US005848789A

United States Patent [19]

Ochi et al.

[11] Patent Number: 5,848,789

[45] Date of Patent: Dec. 15, 1998

[54] MEDIUM SUPPLY APPARATUS WITH ERROR DETECTION

[75] Inventors: Masayoshi Ochi; Tsuyoshi Hanada; Makoto Akiyama, all of Tokyo, Japan

[73] Assignee: Juki Corporation, Tokyo, Japan

[21] Appl. No.: 628,251

[22] Filed: Apr. 5, 1996

[30] Foreign Application Priority Data

Apr. 7, 1995 [JP] Japan ..... 7-082745

[51] Int. Cl.[6] ..... B65H 7/14

[52] U.S. Cl. ..... 271/258.01; 271/262; 271/265.04; 270/52.02

[58] Field of Search ..... 271/9.09, 262, 271/263, 258.01, 265.04; 270/52.02

[56] References Cited

U.S. PATENT DOCUMENTS

| | | | |
|---|---|---|---|
| 3,262,696 | 7/1966 | Zuercher | 270/52.02 |
| 4,456,127 | 6/1984 | Hams | 270/52.02 |
| 5,308,436 | 5/1994 | Walter et al. | 156/441.5 |

FOREIGN PATENT DOCUMENTS

| | | |
|---|---|---|
| 0593078 | 4/1994 | European Pat. Off. . |
| 2195319 | 4/1988 | United Kingdom . |
| 2250275 | 3/1992 | United Kingdom . |

*Primary Examiner*—William E. Terrell
*Assistant Examiner*—Patrick Mackey
*Attorney, Agent, or Firm*—Morgan, Lewis & Bockius LLP

[57] ABSTRACT

The medium supply apparatus includes a delivery passage. In the delivery passage, there is disposed a manual feed tray which, if a cut sheet is manually loaded there, feeds the cut sheet to the delivery passage. The manual feed tray includes a sensor which judges whether the cut sheet is present or not in the tray. When a medium thickness detecting device detects that the cut sheets are double or multiply fed, or when the sheet mark reader detects that the mark of the cut sheet is read in error, then the CPU stops the take-out of the cut sheet from a hopper by an air feed roller as well as the delivery of the cut sheet along the delivery passage. After such stop, if a signal from the sensor indicates that the cut sheet is present in the tray, then the cut sheet is fed to the delivery passage and is then delivered along the delivery passage. After this delivery, the stop of the take-out of the cut sheet from the hopper and the delivery of the cut sheet along the delivery passage is resumed.

21 Claims, 2 Drawing Sheets

MEDIUM SUPPLY APPARATUS WITH ERROR DETECTION

BACKGROUND OF THE INVENTION

The present invention relates to a medium supply apparatus for use in an automatic enclosing and sealing machine.

As a machine for automatically enclosing and sealing a given number of printed sheets such as a detailed statement of use of a bank card, a detailed statement of stock dealings, various leaflets and the like in order to save labor, there is known an automatic enclosing and sealing machine.

Such automatic enclosing and sealing machine includes a medium supply apparatus which is used to supply a given medium to the main body.

Conventionally, the medium, is known as a so called cut sheet, and the medium supply apparatus is known as a cut sheet feeder including a so called bottom feed and air float system.

The cut sheet feeder of a bottom feed and air float system includes a hopper in which cut sheets are stored in a pile, floating and separating means which floats cut sheets in the hopper by use of air and separates the cut sheets from one another in order to eliminate the influences of the upwardly piled cut sheets on the downwardly piled cut sheets, and an air feed roller which is disposed adjacent to a take-out opening formed in the lower end portion of the hopper and, while rotating, attracts a cut sheet to thereby take out the out sheet separated in the lower-most end of the hopper from the take-out opening.

However, even when the cut sheets are separated from one another by use of the air of the floating and separating means and the cut sheet separated in the lower-moot end of the hopper is attracted and taken out by the air feed roller, there is a possibility that two or more cut sheets can be fed together due to static electricity or the like. When a cut sheet with a mark for collation (a mark representing the order of the cut sheet) is used, if such double or multiple feeding occur, then the order of the cut sheet passing through a sheet mark reader cannot be changed. Therefore, it is necessary to provide means for detecting such double or multiple feeding and, if such double or multiple feeding is detected, then the error sheet must be moved back to its take-out waiting position within the hopper, that is, it must be returned to the lower-most surface of the hopper.

Also if an error occurs in reading the mark by the sheet mark reader, similarly, the error sheet must be moved back to its take-out waiting position within the hopper, that is, the lower-most surface of the hopper.

In view of the above, in the above-mentioned conventional sheet feeder, downstream of the air lead roller in the delivery passage, there is provided medium thickness detection means which is used to detect the thickness of a medium (such as a cut sheet). That is, in the conventional sheet feeder, in accordance with a signal from the medium thickness detection means, control means checks whether the cut sheet being currently fed is the double fed sheet or not. Also, when a start mark included in the mark given to the cut sheet cannot be read by the sheet mark reader, in-accordance with a signal from the sheet mark reader, the control means checks whether the cut sheet being currently fed is a mis-read sheet or not. Then, when the control means judges that the currently fed sheet is a double fed or mis-read sheet, then the feeding operation of the currently fed sheet is stopped at once and the double fed or mis-read sheet, that is, the error sheet, is manually returned back to below the bottom surface of the lowest cut sheet within the hopper by an operator after that, the feeding operation is started again. That is, the sheet feeding operation can be recovered without changing the feeding order of the sheets.

However, a problem remains to be solved in the above-mentioned cut sheet feeder.

When the operator returns the double fed or mis-read error sheet by hand to below the bottom surface of the lowest cut sheet within the hopper, after all cut sheets within the hopper are firstly removed from the hopper, the error cut sheet is set in the lower-most stage of the hopper after that, all of the removed cut sheets are returned back into the hopper. That is, the error cut-sheet returning operation is a complicated operation.

SUMMARY OF THE INVENTION

In view of the circumstances of the above-mentioned conventional cut sheet feeder, it is an object of the invention to provide a medium supply apparatus in which, when medium double feeding or medium mark mis-reading occurs, that is, when an error of the order of the medium or an error of delivery of the medium occurs, or mis-reading occurs, a medium delivery operation can be recovered by a simple operation without confusing the order of the mediums.

In attaining the above object, according to a first aspect of the present invention, there is provided a medium supply apparatus which includes a medium storage part for storing therein a plurality of mediums piled one on top of another in order and delivers the medium taken out in the order from the media storage part along a delivery passage, the medium supply apparatus comprising; detect means disposed on the delivery passage for detecting an error of the order of the medium to be delivered or an error of delivery of the medium, stop means for stopping the above medium take-out and delivery operations in accordance with the error detection by the detect means; and, manual feed means including a tray which in disposed on the delivery passage and into which the medium is manually loaded, the manual feed means being used to feed the loaded medium to the delivery passage.

Also, according to a second aspect of the invention, there is provided a medium supply apparatus which includes a medium storage part for storing therein a plurality of mediums piled one on top of another in order and delivers the medium taken out in the order from the medium storage part along a delivery passage, the medium supply apparatus comprising: detect means disposed on the delivery passage for detecting an error of the above order of the medium to be delivered or an error of delivery of the medium; stop means for stopping the above medium take-out and delivery operations in accordance with the error detection by the detect means; manual feed means including a tray which is disposed on the delivery passage and into which the medium is manually loaded, the manual feed means being used to feed the loaded medium to the delivery passage; medium detect means for judging whether the medium is present or not in the manual feed means; and, control means, when the medium is found present by the medium detect means, for controlling the manual feed means to thereby feed the loaded medium to the delivery passage.

According to the first aspect of the invention, a plurality of mediums can be piled one on top of another in order and stored in a pile in a medium storage part and the mediums taken out from the medium storage part in the above order can be delivered along the delivery passage.

If an error of the order of the mediums to be delivered or an error of delivery of the medium occurs, then such error can be detected by detect means and thus the take-out operation of the medium from the medium storage part as well au the delivery operation of the medium are stopped by stop means.

After such stop, if an operator takes out from the delivery passage the medium found as the error medium due to the error of the order or due to the error of the medium delivery and loads it into a tray manually (when this error is double or multiple feeding, then the operator loads the multi-fed two or more mediums one after another by hand without confusing the order of the mediums), then the thus loaded mediums can be fed to the delivery passage by manual feed means.

According to the second aspect of the invention, a plurality of mediums can be piled one on top of another in order and stored in a pile in a medium storage part and the mediums taken out from the medium storage part in the above order can be delivered along the delivery passage.

If an error of the order of the mediums to be delivered or an error of delivery of the medium occurs, then such error can be detected by the detect means and thus the take-out operation of the medium from the medium storage part as well as the delivery operation of the medium are stopped by the atop means.

After such stop, if an operator takes out from the delivery passage the medium found as the error medium due to the error of the medium order at due to the error of delivery of the medium and loads it into a tray manually (when this error is double or multiple feeding, then the operator loads the multi-fed two or more mediums one after another manually without confusing the order of the mediums). Whether the medium is loaded or not is checked by the medium detect means, and, if found loaded, then the control means controls manual feed means to thereby feed the subject medium to the delivery passage automatically.

DETAILED DESCRIPTION OF THE PREFERRED EMBODIMENTS

Now, description will be given below of an embodiment of a medium supply apparatus according to the invention. In the present embodiment, there is shown a cut sheet feeder of a bottom feed and air float system which can be applied to an automatic enclosing and sealing device and also which uses a cut sheet as a medium.

At first, description will be given of the structure of the present cut sheet feeder.

Figure 1:
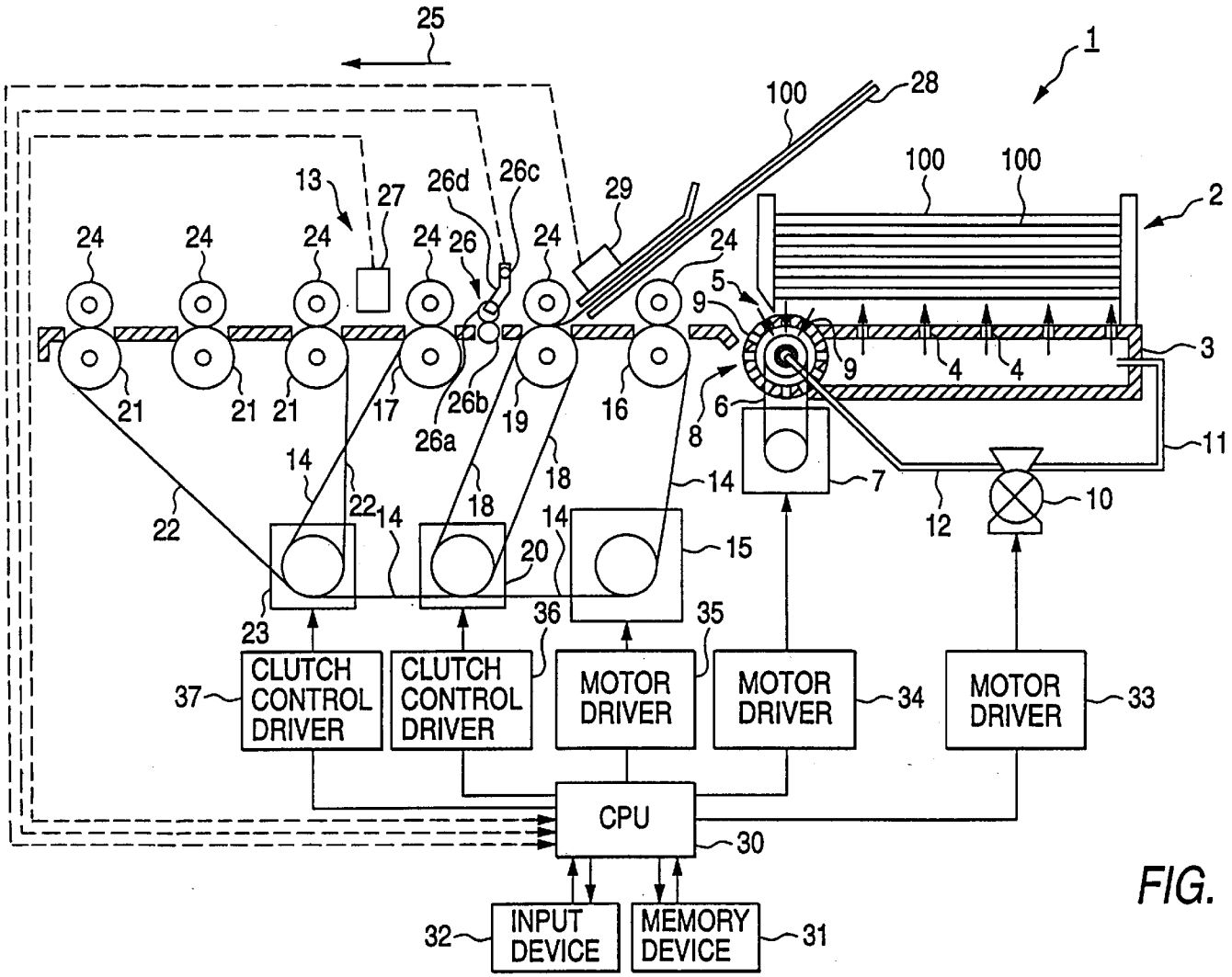
FIG. 1 is a block diagram of the main portions of the general structure of a cut sheet feeder which is an embodiment according to the invention; and, FIG. 2 is a flow chart to explain the operation of the cut sheet feeder according to an embodiment of the invention.

Now, FIG. 1 in a block diagram of a cut sheet feeder 1 according to the present embodiment.

FIG. 1 reference character 2 designates a hopper in which cut sheets 100 are stored in a pile. Downwardly of the hopper 2, there is disposed an air box 3, while the interior of the air box 3 is formed hallow. The air box 3 includes on the hopper 2 side thereof a plurality of openings 4 which are respectively in communication with the interior of the hopper 2. A take-out opening 5 to formed in the bottom portion of the hopper 2 and on the one end side of the lower-most cut sheet 100 and, adjacent to the take-out opening 5, there is disposed an air feed roller 8 which can be driven by a motor 7 through a timing belt 6. The interior of the air feed roller a is formed hollow and, in the outer peripheral wall of the air feed roller 8, there are formed a plurality of openings 9 which allow the interior of the air feed roller 8 to communicate with the outside thereof.

Reference character 10 stands for a blower fan which can be driven by a blower motor (not shown). The blower fan 10 includes a blow pipe 11 and a vacuum pipe 12, while the blow pipe 11 is connected to the interior of the air box 3 and the vacuum pipe 12 is connected to the interior of the air feed roller 8. Also, the air within the air box 3 is in communication with the air within the air feed roller 8. If the blower fan 10 is driven by the blower motor (not shown), then the air is blown out from the openings 4 of the air box 3, so that the cut sheets 100 within the hopper 2 are blown up and are thereby floated up and, at the same time, they are separated from one another; and, due to rotation of the air feed roller 8, the air is sucked from the openings 9 of the air feed roller 8 and the lower-most one of the separated cut sheets 100 is sucked out of the hopper 2.

Downstream of the take-out opening 5, there is arranged a delivery passage 13. In the delivery passage 13, there are provided drive rollers 16 and 17 which can be driven by a motor 15 through a timing belt 14. There is also-provided a drive roller 19 which can be driven by the motor 15 through a clutch 20 for connecting and disconnecting the driving of the timing belts 14, 18 and motor 15. The drive roller 19 is interposed between two drive rollers 16 and 17 in the delivery passage 13.

Downstream of the drive rollers 16, 19 and 17, there are disposed a plurality of delivery rollers 21 in parallel to one another which can be respectively driven by the motor 15 through a clutch 23 for connecting and disconnecting the driving of the timing belts 14, 22 and motor 15. The drive rollers 16, 17, 19 and the delivery rollers 21 are respectively in contact with a plurality of rollers 24 and, if the motor 15 is driven while the clutches 20 and 23 are connected, then the cut sheet taken out from the take-out opening 5 is delivered in a direction of an arrow 25 while it is held by and between the rollers in contact.

Between the drive rollers 17 and 19 in the delivery passage 13, there is interposed a medium thickness detect device 26. The medium thickness detect device 26 is of a so called roller pickup system which includes a first roller 26*a* for guiding the cut sheet 100, which is delivered by the drive rollers 16 and 19, in the arrow 25 direction; a second roller 26*b* which rotates in contact with the first roller 26*a*, holds the cut sheet 100 between the first roller 26*a* and itself, and guides the cut sheet 100 in the arrow 25 direction; an arm 26*d* which supports the first roller 26*e*rotatably on one end thereof, while the other end thereof is rotatably supported by a support shaft 26*c*; and, a thickness sensor (not shown) for detecting the displacement of the arm 26*d*. In the medium thickness detect device 26, the cut sheet 100 is made to pass through between the first roller 26*a* and the second roller 26*b*, and the rotational displacement of the arm 26*d* when the cut sheet 100 passes therethrough is detected by the thickness sensor (not shown).

Between the drive roller 17 and delivery roller 21 in the delivery passage 13, there is disposed a sheet mark reader 27. As the sheet mark reader 27, for example, there is used an OMR (Optical Mark Reader) which distinguishes the marks (such as tho order of the cut sheets 100 or the like) of the respective cut sheets 100 from one another.

In the delivery passage 13, upstream of the medium thickness detect device 26 and sheet mark reader 27, there is disposed a manual feed tray 28. In particular, if the cut sheets 100 are manually loaded one after another into the manual feed tray 28, the leading end of the cut sheet 100 is led to a position between the drive roller 19 and the roller 24 in contact with the drive roller 19. The cut sheet 100 is fed into the delivery passage 13 by the drive roller 19 and the roller 24. Also, the manual feed tray 28 includes a sensor 29 which is used to detect whether the cut sheet 100 is loaded into the manual feed tray 28 or not.

Now, reference character 30 designates a CPU (Central Processing Unit) to which are connected the motor 7, the blower motor (not shown) for driving the blower fan 10, the motor 15, the clutches 20 and 23, the medium thickness detect device 26, the sheet mark reader 27, and the sensor 29. The motor 7, the blower motor (not shown) for driving the blower fan 10, and the motor 15 are respectively connected to the CPU 30 through motor drivers 34, 33 and 35, respectively. Also, the clutches 20, 23 are respectively connected to the CPU 30 through clutch control drivers 36 and 37 which are respectively used to control the clutches.

The CPU 30 performs various calculations in accordance with various control programs stored within a memory device 31 (which will be described later) and, based on the results of the calculating processings, outputs various control signals to the respective parts of the out sheet feeder 1.

Especially, if the cut sheet 100 is found in accordance with a signal from the medium thickness detect device 26 that it is fed together with another cut sheet or fed double, or if the mark of the cut sheet 100 is found mis-read in accordance with a detect signal from the sheet mark redder 27, then the air feed roller 8, drive roller 19 and delivery roller 21 are caused to stop, and the take-out operation of the cut sheet 100 from the hopper 2 as well as the delivery operation of the cut sheet 100 along the delivery passage 13 are stopped.

Also, after stopping the above operations, if it is judged in accordance with a signal from the sensor 29 that the cut sheet 100 is present in the manual feed tray 28, then the cut sheet 100 is fed from the manual feed tray 28 into the delivery passage 13 and is then delivered along the delivery passage 13. Further, after such delivery, the take-out operation of the cut sheet 100 from the hopper 2 as well as the delivery operation of the cut sheet 100 along the delivery passage 13 are resumed so that the operations are recovered.

The memory device 31 included a ROM (Read Only Memory) comprising a fixed memory which stores therein various control programs for controlling the whole of the cut sheet feeder 1, and a RAM (Random Access Memory) comprising a volatile memory which stores therein the operation results of the CPU 31 and the like temporarily.

An input device 32 is an operation panel which is used to perform a given input operation into the CPU 30. Especially, the input device 32 includes an operation start key for instructing the start of the operation of the cut sheet feeder 1, a given error recovery key, and a stop key for instructing the end of the operation of the cut sheet feeder 1.

Next, description will be given below of the operation of the cut sheet feeder according to the present embodiment.

Figure 2:
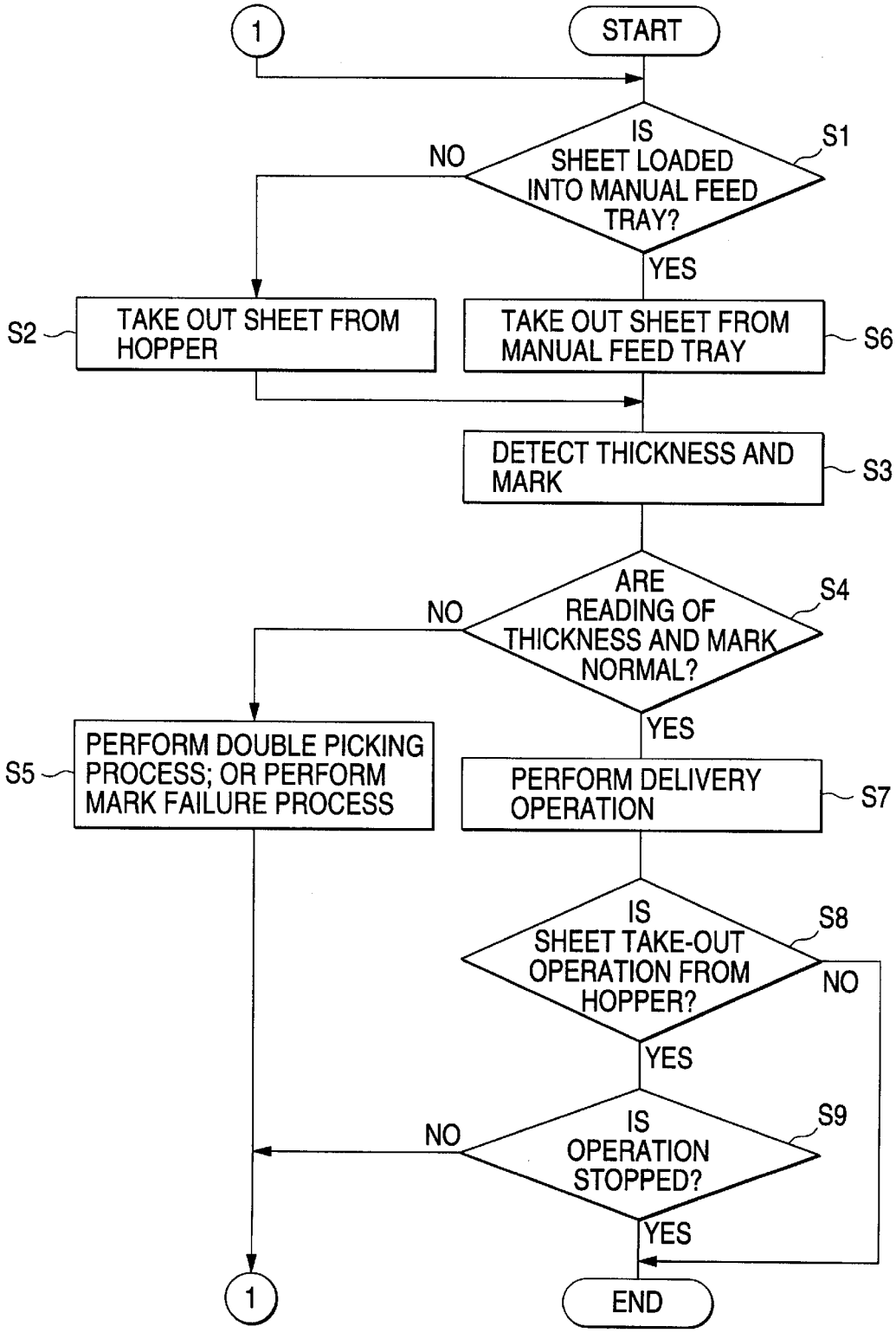

Now, FIG. 2 is a flow chart to explain the operation of the present cut sheet feeder.

At first, if the operation start key (not shown) of the input device 32 is operated and the operation of the cut sheet feeder 1 is thereby started, then the CPU 30 judges in accordance with a signal from the sensor 29 that the cut sheet 100 is loaded into the manual feed tray 28 or not (Step S1). Since a cut sheet 100 is not loaded before the start of the operation of the cut sheet feeder 1, a cut sheet 100 is taken out from the hopper 2 (Step S2). That is, the CPU 30 transmits a control signal to the motor driver 33 to thereby drive the air feed roller 8 and blower fan 10. In response to this driving, the air is blown out from the openings 4 of the air box 3, so that the respective cut sheets 100 within the hopper 2 are blown up and float and they are separated from one another. In this operation, the air is sucked in from the openings 9 of the air feed roller 8, so that the lower-most one of the separated cut sheets 100 is sucked onto the air feed roller 8. At the same time, the CPU 30 transmits a control signal to the motor driver 34 to thereby rotate the air feed roller 8 forward. As a result of this, the lower-most cut sheet 100 sucked to the air feed roller 8 is taken out from the take-out opening 5 of the hopper 2 as the air feed roller 8 is rotated forwardly.

Also, the CPU 30 transmits a control signal to the motor driver 35 to drive the motor 15 with the clutches 20, 23 connected, thereby rotating the drive rollers 16, 17, 19 and delivery rollers 21 respectively.

With the rotation of the drive roller 16, 17 and 19, the cut sheet 100 is delivered in the arrow 25 direction to thereby reach the installed positions of the medium thickness detect device 26 and sheet mark reader 27. And, the thickness of the cut sheet 100 is detected by the medium thickness detect device 26, while the mark given to the cut sheet 100 is distinguished by the sheet mark reader 27 (Step S3).

Next, in accordance with detect signals from the medium thickness detect device 26 and sheet mark reader 27, it is checked whether the reading of the thickness of the cut sheet 100 and the mark are normal or not (Step S4). If it is found in accordance with the detect signal from the thickness detect device 26 that two or more cut sheets 100 are fed together, or if the start mark of the mark given to the cut sheet 100 cannot be read, then a given double picking processing or a mark reading failure processing is performed (Step S5). That is, the CPU 30 transmits control signals to the motor driver 34 and clutch drivers 36, 37 to thereby stop the motor 7 and cut off the clutches 20, 23. As a result of this, the air feed roller 8 and drive rollers 19, 21 are caused to stop, so that the delivery of the present cut sheet 100 is stopped and the taking-out of the cut sheet 100 from the hopper 2 is also stopped.

An operator manually takes out the present cut sheet 100 from the delivery passage 13, loads it into the manual feed tray 28 (for double picking, loads the double fed or picked cut sheets 100 one by one without changing the order of these cut sheets 100), and the present cut sheet 100 is slid into the manual feed tray 28. The leading end of the present cut sheet is positioned between the rollers 19 and 24. The error recovery key (not shown) of the input device 32 is operated, then the CPU 30 judges from a signal from the sensor 29 whether the cut sheet 100 is loaded into the manual feed tray 28 or not (Step S1). In this case, since the cut sheet 100 is loaded, the CPU 30 issues control signals to the clutch control drivers 36 and 37 to connect the clutches 20 and 23, whereby the cut sheet 100 is fed from the manual feed tray 28 into the delivery passage 13 due to the rotation of the drive roller 19 and is then delivered along the delivery passage 13 (Step 6).

After then, if the cut sheet 100 fed from the manual feed tray 28 into the delivery passage 13 reaches the installation position of the sheet mark reader 27, then the processings of the above-mentioned steps S3 and S4 are performed again.

In other words, also for the error cut sheet 100 on which the double picking processing or mark reading failure processing has been performed, processings to detect the thickness of the cut sheet 100 and to distinguish the mark given to the cut sheet 100 are executed again (Step S3), and, it is checked in accordance with signals respectively from the medium thickness detect device 26 and sheet mark reader 27 whether the thickness of the cut sheet 100 and the reading of the mark of the cut sheet 100 are normal or not (Step S4). If found not normal, then the processings in the above-mentioned step S5 and its following steps are performed again. On the other hand, if found normal, then the delivery operation of the cut sheet 100 is carried out (Step S7). Unlike Step S5, in Step S7, the driving of the air feed roller 8, delivery roller 21 and drive roller 19 is kept on to thereby deliver the cut sheet 100 found normal, that is, the thickness of the present cut sheet 100 and the mark reading thereof are both judged normal.

After then, it is checked whether the cut sheet 100 take-out operation is from the hopper 2 or not (Step S8). As a result of this, if the cut sheet 100 take-out operation is found from the manual feed tray 28, then the operation of the cut sheet feeder 1 is automatically stopped. Further, if an error cut sheet 100 is found (for example, if three or more cut sheets are fed together), then the next error sheet 100 is loaded into the manual feed tray 28 and the operation of the cut sheet feeder 1 is started again by use of the operation start key (not shown), On the other hand, if the cut sheet 100 take-out operation is found from the hopper 2, unless the stop key (not shown) of the input device 32 is operated, the processing goes back to Step S1 and, after then, the processings in the above-mentioned steps S1–S8 are carried out again, so that the cut sheets 100 within the hopper 2 are taken out one after another from the lower-most stage of the hopper 2 and are then delivered along the delivery passage 13. However, if the stop key (not shown) of the input device 32 is operated, then the operation of the cut sheet feeder 1 in stopped (Step S9), thereby ending all of the processings.

According to the cut sheet feeder 1 of the present embodiment that has been described heretofore, it is possible to provide a cut sheet feeder in which, when the double feeding of the cut shoots 100 occurs or the mark given to the cut sheet 100 is found misread, simply by operator's taking out the subject error cut sheet 100 from the delivery passage 13 and loading it into the manual feed tray 28, the delivery operation of the cut sheet 100 can be recovered without confusing the order of the cut sheets 100.

Also, since the manual feed tray 28 is disposed upstream of the medium thickness detect device 26 in the cut sheet delivery flow of the delivery passage 13, for the error cut sheet to be returned from the manual feed tray 28 to the delivery passage 13, as described above, it is checked again whether the thickness of the error out sheet is normal or not and, it found not normal, then the double picking processing is performed. Therefore, in returning the two or more multi-fed (fed together in error) cut sheets 100 from the manual feed tray 28 to the delivery passage 13, even if the operator has loaded in error the two or more cut sheets 100 into the manual feed tray 28, they are prevented from being fed together along the delivery passage 13.

Further, because the manual feed tray 29 is disposed upstream of the sheet mark reader 27 in the delivery flow of the delivery passage 13, for the error cut sheet 100 to be returned from the manual feed tray 28 to the delivery passage 13, as described above, it is checked again whether the mark reading of the error cut sheet 100 is normal or not and, if found not normal, then the above-mentioned mark reading failure processing is performed. For this reason, in returning the multi-fed two or more cut sheets 100 from the manual feed tray 28 back to the delivery passage 13, even if the operator makes an error in setting the order of the cut sheet 100 to be manual loaded, there is eliminated the possibility that the cut sheet 100 can be fed with the order remaining confused.

In addition, when a cut sheet 100 which has been judged once that the mark thereof was read in error and thus has a high possibility that the mark thereof can be judged again as a mis-read mark cut sheet is returned from the manual feed tray 28 to the delivery passage 13, it is checked again whether the mark thereof is mis-read or not and, if mark mis-reading is found again, then the mark reading failure processing is performed again. For this reason, the possibility that the order of the cut sheets 100 to be delivered after the present cut sheet 100 can be confused.

According to the first aspect of the invention, a plurality of media can be piled one on top of another in order and stored in a pile in a medium storage part and the media taken out from the medium storage part in the above order can be delivered along a delivery passage.

If an error of the order of the media to be delivered or an error of delivery of the medium occurs, then such error can be detected by detect means and thus the take-out operation of the medium from the medium storage part as well as the delivery operation of the medium are stopped by the stop means.

After such stop, if an operator takes out from the delivery passage the medium found as the error medium due to the error of the order of the media or due to the error of delivery of the medium and manually loads the error medium into a tray (when this error is double or multiple feeding, then the operator manually loads the multi-fed two or more media one after another without confusing the order of the media), then the thus loaded mediums can be fed to the delivery passage manual feed means.

Therefore, according to the present invention, it is possible to provide a medium supply apparatus in which, when an error of the order of the media or an error of delivery of the medium occurs, by a simple operation that the operator takes out the subject error medium from the delivery passage, manually it into the tray and feeds it to the delivery passage by use of the manual feed means, the medium delivery operation can be recovered without confusing the order of the media.

According to the second aspect of the invention, a plurality of media can be piled one on top of another in order and stored in a pile in the medium storage part and the media taken out from the medium storage part in the above order can be delivered along a delivery passage, If an error of the order of the media to be delivered or an error of delivery of the medium occurs, then such error can be detected by detect means and thus the take-out operation of the medium from the medium storage part as well as the delivery operation of the medium are stopped by the stop means.

After such stop, an operator takes out from the delivery passage the medium found as the error medium due to the error of the order of the mediums or due to the error of delivery of the medium and manually loads it into a tray (when this error is double or multiple feeding, then the operator manually loads the multi-fed two or more media one after another without confusing the order of the media). Whether the medium is loaded or not is checked by the medium detect means, and, if found loaded, then the control means controls manual feed means to thereby feed the subject medium to the delivery passage automatically.

Therefore, according to the present invention, it is possible to provide a medium supply apparatus in which, when an error of the order of the media or an error of delivery of the medium occurs, by a simple operation that the operator takes out the subject error medium from the delivery passage and manually loads it into the tray, the medium delivery operation can be recovered without confusing the order of the media.

We claim:

1. A medium supply apparatus which includes a medium storage part for storing therein a plurality of media piled one on top of another in order and means for taking out and delivering the medium in order from the medium storage part along a delivery passage, said medium supply apparatus comprising:

detecting means disposed on the delivery passage, for detecting an error of the order of the medium to be delivered;

stopping means for stopping the means for taking out and delivering operations in accordance with the error detection by said detecting means;

manual feeding means including a tray which is disposed on the delivery passage and into which the medium is manually loaded, for feeding the loaded medium to said delivery passage;

medium sensing means for judging whether the medium is present in the manual feeding means; and control means, when the medium is found present by the medium sensing means, for controlling the manual feeding means to feed the loaded medium to the delivery passage after controlling the stopping means to stop the means for taking out and delivering operations while the rest of the media are still stored in the medium storage part.

2. A medium supply apparatus which includes a medium storage part for storing therein a plurality of media piled one on top of another in order and means for taking out and delivering the medium in order from the medium storage part along a delivery passage, said medium supply apparatus comprising:

detecting means disposed on the delivery passage, for detecting an error of the order of the medium to be delivered and an error of delivery of the medium; stopping means for stopping the means for taking out and delivering operations in accordance with the error detection by said detecting means;

manual feed means including a tray which is disposed on the delivery passage and into which the medium is manually loaded, for feeding the loaded medium to the delivery passage;

medium sensing means for judging whether the medium is present in the manual feed means; and, control means, when the medium is found present by the medium sensing means, for controlling the manual feed means to feed the loaded medium to the delivery passage after controlling the stopping means to stop the means for taking out and delivering operations while the rest of the media are still stored in the medium storage part.

3. The medium supply apparatus of claim 1, wherein the plurality of media include a mark and the detecting means includes a mark reader to read the mark.

4. The medium supply apparatus of claim 3, wherein the mark reader is an optical mark reader.

5. The medium supply apparatus of claim 1, wherein the stopping means includes a control unit, a clutch, and a clutch driver, the clutch driver connecting the control unit to the clutch, and the clutch being connected to a roller along the delivery passageway.

6. The medium supply apparatus of claim 1, wherein the manual feeding means includes a sensor for detecting the presence of a medium in the tray.

7. The medium supply apparatus of claim 2, wherein the plurality of media include a mark and the detecting means includes a mark reader to read the mark.

8. The medium supply apparatus of claim 7, wherein the mark reader is an optical mark reader.

9. The medium supply apparatus of claim 2, wherein the detecting means includes a thickness detector including an arm pivotally connected at one end to a support shaft and having a roller at the other end, the roller contacting the medium as the medium moves in the delivery passage, and wherein the rotational displacement of the arm is detected.

10. The medium supply apparatus of claim 2, wherein the stopping means includes a control unit, a clutch, and a clutch driver, the clutch driver connecting the control unit to the clutch, and the clutch being connected to a roller along the delivery passageway.

11. The medium supply apparatus of claim 2, wherein the medium sensing means includes a sensor.

12. A medium supply apparatus which includes a medium storage part for storing therein a plurality of media piled one on top of another in order and means for taking out and delivering the medium in order from the medium storage part along a delivery passage, said medium supply apparatus comprising:

an order detecting means disposed on the delivery passage, for detecting an error of the order of the medium to be delivered;

a thickness detecting means disposed on the delivery passage, for detecting an error of delivery of the medium;

a stopping means for stopping the means for taking out and delivering operations in accordance with the error detection by said detecting means;

a manual feeding means including a tray which is disposed on the delivery passage and into which the medium is manually loaded, for feeding the loaded medium to said delivery passage;

medium sensing means for judging whether the medium is present in the manual feeding means; and control means, when the medium is found present by the medium sensing means, for controlling the manual feeding means to feed the loaded medium to the delivery passage after controlling the stopping means to stop the means for taking out and delivering operations while the rest of the media are still stored in the medium storage part.

13. The medium supply apparatus of claim 12, wherein the plurality of media include a mark and the order detecting means includes a mark reader to read the mark.

14. The medium supply apparatus of claim 13, wherein the mark reader is an optical mark reader.

15. The medium supply apparatus of claim 12, wherein the order detecting means includes a mark reader that distinguishes a mark on a medium from a mark on another medium.

16. The medium supply apparatus of claim 12, wherein the thickness detecting means includes an arm pivotally connected at one end to a support shaft and having a roller at the other end, the roller contacting the medium as the medium moves in the delivery passage, and wherein the rotational displacement of the arm is detected.

17. The medium supply apparatus of claim 12, wherein the stopping means includes a control unit, a clutch, and a clutch driver, the clutch driver connecting the control unit to the clutch, and the clutch being connected to a roller along the delivery passageway.

18. The medium supply apparatus of claim 12, wherein the manual feeding means includes a sensor for detecting the presence of a medium in the tray.

19. The medium supply apparatus of claim 12, wherein the manual feeding means is downstream along the delivery passageway from the medium storage part.

20. The medium supply apparatus of claim 1, wherein the detecting means is positioned downstream from the manual feeding means.

21. The medium supply apparatus of claim 2, wherein the detecting means is positioned downstream from the manual feed means.

* * * * *